US005226458A

United States Patent [19]

Bamelis

[11] Patent Number: 5,226,458

[45] Date of Patent: Jul. 13, 1993

[54] DEVICE FOR THE STRETCHING OF A WEFT THREAD IN WEAVING MACHINES

[75] Inventor: Jean-Marie Bamelis, Ieper, Belgium

[73] Assignee: Picanol N.V., Naamloze Venootschap, Ieper, Belgium

[21] Appl. No.: 816,260

[22] Filed: Jan. 3, 1992

[30] Foreign Application Priority Data

Jan. 4, 1991 [BE] Belgium ..... 9100004

[51] Int. Cl.[5] ..... D03D 47/34

[52] U.S. Cl. ..... 139/194; 139/188 R; 139/116.2

[58] Field of Search ..... 139/194, 188 R, 302, 139/430, 435.4, 116.2

[56] References Cited

U.S. PATENT DOCUMENTS

| | | | |
|---|---|---|---|
| 3,744,533 | 7/1973 | Yano et al. | 139/194 |
| 4,096,889 | 6/1978 | Larmit . | |
| 4,367,772 | 1/1983 | Wall | 139/435.4 |
| 4,542,772 | 9/1985 | Gaschutz | 139/435.4 |
| 4,936,353 | 6/1990 | Volland et al. . | |

FOREIGN PATENT DOCUMENTS

| | | | |
|---|---|---|---|
| 1000989 | 5/1989 | Belgium . | |
| 0393468 | 10/1990 | European Pat. Off. | 139/194 |

*Primary Examiner*—Andrew M. Falik
*Attorney, Agent, or Firm*—Bacon & Thomas

[57] ABSTRACT

A device for stretching a weft thread in weaving machines includes a stretching nozzle mounted on the sley of the weaving machine and a blower device for removing weft threads from the stretching nozzle. The blower device is mounted on the sley near the stretching nozzle.

10 Claims, 2 Drawing Sheets

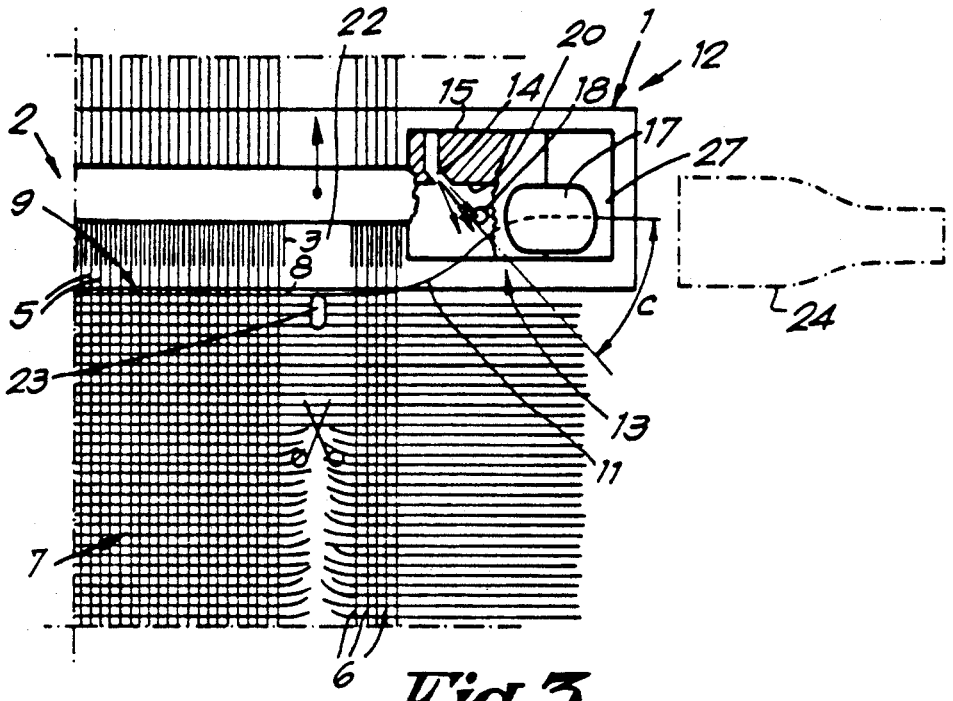
Fig. 3
Fig. 4
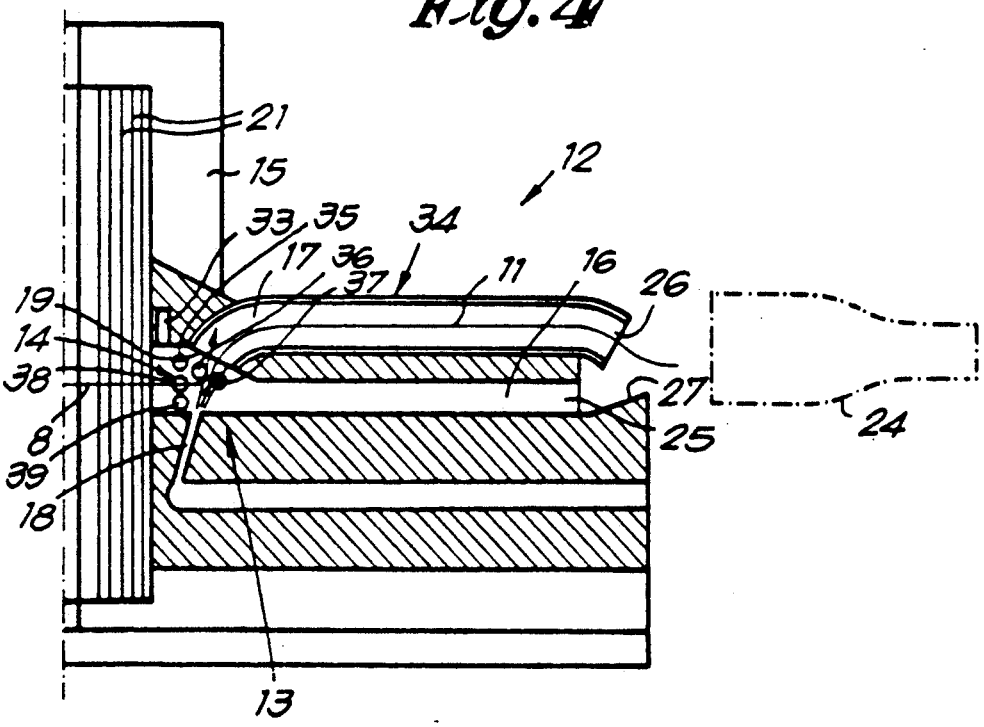

DEVICE FOR THE STRETCHING OF A WEFT THREAD IN WEAVING MACHINES

BACKGROUND OF THE INVENTION

The present invention concerns a device for the stretching of a weft thread in weaving machines, in other words a device which is installed at the end of the shed of a weaving machine so as to catch a weft thread inserted in the shed, and so as to avoid the recoil of the weft thread at the end of the insertion, and keep it taut during the beating up.

It is known that such devices consist of a thread guide duct in which the ends of the weft threads are caught and that they are kept taut by means of an air stream in this thread guide duct. It is also known that such a device maybe attached to the sley, such that the caught thread ends, if they have a normal length, are automatically released from the thread guide duct during the return movement of the sley, as a result of which the thread guide duct is always free at the beginning of the next insertion.

If a strongly twisted weft thread is used, one should weave with a relatively long waste end, so as to make sure that the stretch effect is sufficiently great to avoid the situation in which the weft thread recoils and screws up in the shed. With such long waste ends the course of the sley is insufficient to ensure that the weft thread, after beating up against the cloth line, is released from the above-mentioned thread guide duct of the stretching device. As a result, that several threads end up in the thread guide duct of the stretching device, which may cause obstructions.

A known solution to this problem consists in using a thread guide duct with a larger diameter, but this is disadvantageous in that the consumption of air is great and in that the stretching force is relatively small.

Another known solution is described in Belgian patent No. 1.000.989, whereby use is made of an auxiliary nozzle which is fixed on the weaving machine, in particular near the cloth line of the fabric. This auxiliary nozzle is useful in case weft threads are used with a waste end of a normal length, but it is inefficient with weft threads having long waste-ends as mentioned above, because in the rearmost position of the sley the force exerted by said auxiliary nozzle on the waste end situated in the stretching nozzle is insufficient to blow this waste end out of the thread guide duct.

SUMMARY OF THE INVENTION

An objective of the invention is device which does therefore to provide a device which does not have the above mentioned disadvantages.

To this end the invention concerns a device for the stretching of a weft thread in weaving machines, which includes a stretching nozzle mounted on the sley of the weaving machine and a blower device to remove the weft threads from the stretching nozzle, characterized in that blower device is mounted near the stretching nozzle on the sley.

The construction according to the invention offers the advantage that the above-mentioned blower device is permanently situated near or adjacent the thread guide duct of the stretching nozzle, as a result of which the air jet of this blower device can always be optimally used to remove the weft threads from the stretching nozzle.

In preference use is made in the stretching nozzle of a curved thread guide duct, whose entry is at a non-zero angle with respect to the weft direction. This has the advantage that the weft thread is bent, as a result of which it undergoes a greater friction against the walls of the thread guide duct, such that the recoiling of the thread is avoided.

In order to obtain an optimum effect, the above-mentioned blower device is mounted such that it blows from behind the thread guide duct of the stretching nozzle in the direction of the cloth line. The stretching nozzle and the to blower device for to removing the weft threads from the stretching nozzle are thus switched on and off at the right moments as a function of the weaving cycle.

BRIEF DESCRIPTION OF THE DRAWINGS

In order to better explain the characteristics according to the invention, by way of example only and without being limitative in any way, the following preferred embodiments are described with reference to the accompanying drawings, in which:

FIG. 3 shows a view according to arrow F3 in FIG. 1;

FIG. 4 is a cross-sectional top view which shows a variant of the device of FIG. 1.

DETAILED DESCRIPTION OF THE PREFERRED EMBODIMENTS

Figure 1:
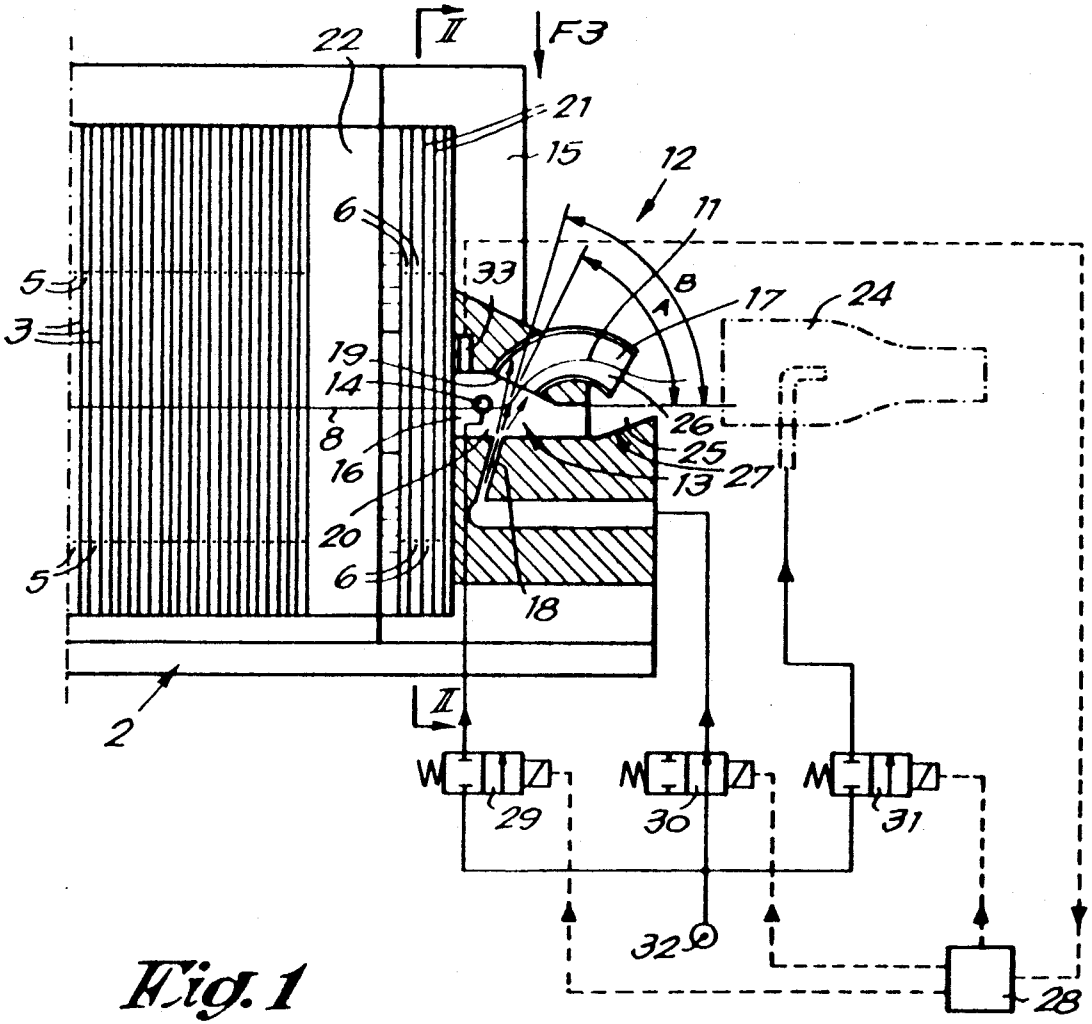
FIG. 1 is a cross-sectional top view, partially in schematic form, which shows the device according to the invention.
Figure 2:
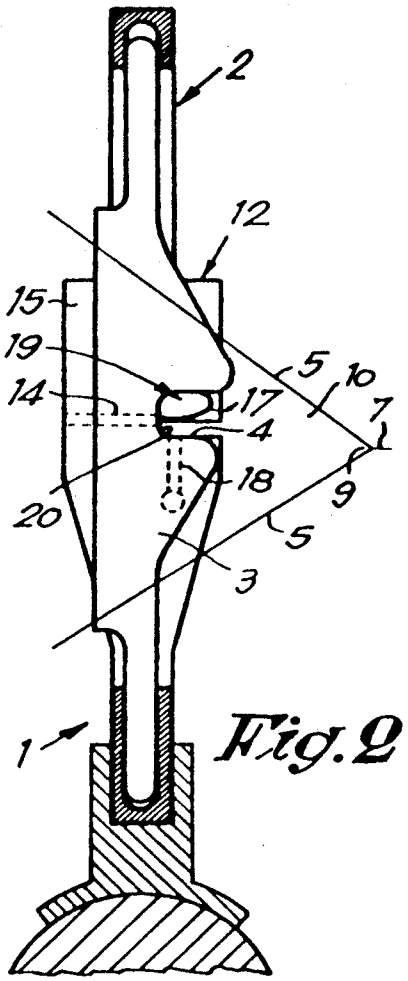
FIG. 2 is a plan view taken in the direction of line II—II in FIG. 1.

FIGS. 1 to 3 show a part of a sley 1 with a U-shaped reed 2, whereby as is known the reed blades 3 have recesses which form a thread transport duct 4. For clarity's sake, also the warp threads 5, the catch threads 6, the fabric 7, the weft thread 8, the cloth line 9 and the shed 10 are represented. As is known the weft thread 8 is blown through the thread transport duct 4, whereby the required air stream is realized by means of a main nozzle and a number of relay nozzles not represented in the figures.

As shown in FIG. 1 at the end of each insertion a tensile force is exerted on the waste end 11 so as to keep the weft thread 8 taut. According to the present invention use is made to this end of a device 12 which, as shown in FIGS. 1 to 3, includes a stretching nozzle 13 mounted on the sley 1 of the weaving machine and a blower device 14 to remove the weft threads 8 from the stretching nozzle 13, whereby this blower device 14 is also mounted on the sley 1.

According to the invention the stretching nozzle 13 and the blower device 14 are applied in one and the same piece 15 which is either mounted against the reed 2 on the sley 1 or made in one piece with the reed 2.

As shown in the FIGS. 1 to 3 this piece 15 has a through duct 16 which is closed off at three ends and which forms an extension of the above-mentioned thread transport duct 4.

The stretching nozzle 13 includes a thread guide duct 17 and a blowing nozzle 18 cooperating with it so as to create an air stream in the thread guide duct 17.

The thread guide duct 17 preferably has a bent shape and comes out sideways in the duct 16. The direction of the thread guide duct 17 at the place of its entry 19 forms for example an angle A of 65 degrees with the weft direction of the weft thread 8.

The blowing nozzle 18 is situated opposite the entry 19. This blowing nozzle 18 blows for example at an angle B with regard to the weft direction, which is greater than the above-mentioned angle A. This angle B is for example 75 degrees.

The fact that the thread guide duct 17 is curved and connects sideways with the duct 16 offers the advantage that the waste end 11 is prevented from recoiling due to the contact with the walls of the thread guide duct 17.

The fact that the blowing nozzle 18 is situated opposite the thread guide duct 17 offers the advantage that this blowing nozzle 18 forms no obstruction in the path followed by the waste end 11.

The above-mentioned blower device 14 is situated near the entry 19 of the thread guide duct 17, such that it can exert an optimal force on the waste end 11. In the embodiment shown the blower device 14 is situated in the back wall 20 of the duct 16, such that it blows from behind the thread guide duct 17 in the direction of the cloth line 9.

In order to obtain an optimal performance, the blower device 14 is mounted in preference such that the outcoming air jet forms an angle C with the weft direction of 10 to 30 degrees, such that the waste end 11 of the fabric 7 is blown away.

The above-mentioned piece 15 also has a number of so-called false reed blades 21, which provide a passage for the catch threads 6. According to the invention there is an opening 22 between the reed blades 3 for the warp threads 5 and the reed blades 21 for the catch threads 6, which makes it possible to place a thread clip 23 at the height of the cloth line 9.

As shown in FIGS. 1 and 3 a known suction nozzle 24 may be mounted next to the sley 1 to catch and carry off faulty weft threads 8 to be removed, whereby these weft threads can be guided to the suction nozzle 24 both along the thread guide duct 17 and along the duct 16. Also, the outlets 25 and 26 of the duct 16 and the thread guide duct 17 face towards this suction nozzle 24. The duct 16 is provided with a sloping, upright edge 27 to this end.

The blower device 14, the blowing nozzle 18 and the suction nozzle 24 are preferably controlled by means of a control unit 28 which respectively connects these elements to the compressed air source 32 via the required valves 29, 30 and 31. The blower device 14 and the blowing nozzle 18 are switched on as a function of the weaving cycle, for example by taking into account the signal a thread detector 33 placed at the entry of the duct 16.

The operation of the device is mainly as follows. At each weaving cycle a weft thread 8 is inserted in the shed 10 by means of an air stream through the thread transport duct 4. The stretching nozzle 13 is switched one such that the waste end 11 is blown in the thread guide duct 17 when the weft thread 8 reaches the end of the shed 10. Subsequently, the sley 1 moves forward, such that the weft thread 8 is beaten up against the cloth line 9 and pressed in the thread clip 23. Then the sley 1 moves backward again and the warp threads 5 are crossed, such that the weft thread 8 is bound in. As the sley 1 moves back, the stretching nozzle 13 is switched off and the blower device 14 is switched on. During this movement of the sley 1 the waste end 11 comes out of the thread guide duct 17, on the one hand because the distance between the cloth line 9 and the sley 1 is extended, and on the other hand because the weft thread 8 is kept in the thread clip 23 and because the waste end 11 is blower device 14, the stretching nozzle 13 through the blower device 14, irrespective of the length of this waste end 11. The blow device 14 is switched off before the next weft thread 8 reaches the end of the shed 10.

In preference, use is made of an extension piece 34 for the thread guide duct 17 so as to prevent the waste end 11 from getting caught behind the outlet 26 of the thread guide duct 17. An example of this is shown in FIG. 4. Also the duct 16 is longer, so that both ends 25 and 26 end before the suction nozzle 24. The extension piece 34 is preferably so long that the thread guide duct 17 has a total length of at least 3 cm.

The blower device 14 is preferably made such that the outcoming air covers the entire entry 19 as well as the entire intersection of the duct 16. As a result, the weft thread 8 is blown out of the thread guide duct 17 with certainty, irrespective of its position with regard to the thread guide duct 17 and the duct 16. As shown in the embodiment of figure use can be made to this end of a blower device 14 with several blower openings 35 to 39.

The blower openings 35, 36 and 37 are set up near the entry 19 of the thread guide duct 17, such that the air stream entirely covers the entry 19.

The blower openings 35, 38 and 39 cover the intersection of the duct 16.

The series of blower openings 35, 36 and 37 on the one hand, and the blower openings 35, 38 and 39 on the other hand may optionally be used in combination.

The present invention is in no way limited to the embodiments described by way of example and shown in the accompanying drawings; on the contrary, such a device for the stretching of weft threads in weaving machines can be made in various forms and dimensions while still remaining within the scope of the invention.

I claim:

1. In a device for stretching a weft thread in a weaving machine which includes a sley, the improvement comprising:

means including a stretching nozzle mounted on a sley for stretching a weft thread, said stretching nozzle including first means for creating an air stream; and second means for creating an air stream in order to remove the weft thread from the stretching nozzle, wherein said second means is mounted adjacent the stretching nozzle on the sley.

2. A device as claimed in claim 1, wherein said stretching nozzle comprises a thread guide duct and said first means comprises a blower nozzle situated to a face an entry of the thread guide duct, wherein said entry and said blower nozzle are situated on opposite sides of an extension duct comprising an extension of a thread transport duct.

3. A device as claimed in claim 2, wherein said second means is situated in a wall of said extension duct.

4. A device as claimed in claim 2, wherein an outlet of the thread guide duct and an outlet of the extension duct face towards means including a suction nozzle for removing faulty weft threads.

5. A device as claimed in claim 1, further comprising means including separate valves controlled by a control unit for controlling the stretching nozzle and the second means to in order to remove weft threads from the stretching nozzle.

6. In a device for stretching a weft thread in a weaving machine which includes a sley, the improvement comprising:

means including a stretching nozzle mounted on a sley for stretching a weft thread; and means including a blower device for removing the weft thread from the stretching nozzle, wherein said blower device is mounted adjacent the stretching nozzle on the sley, wherein the stretching nozzle comprises a thread guide duct, and wherein said blower device is situated adjacent an entry of the thread guide duct.

7. A device as claimed in claim 6, wherein said blower device comprises means including at least one blower opening situated to cooperate with said entry in order to create a stream of blow air, said blown air covering the entire entry whereby a force is exerted on a waste end of the weft thread.

8. A device as claimed in claim 6, wherein said thread guide duct communicates with an extension duct comprising an extension of the thread transport duct, and wherein said blower device comprises means including at least one blower opening for causing blown air to cover an entire intersection between said thread guide duct and said extension duct, whereby the weft thread is blown out of the thread guide duct irrespective of its position relative to the thread guide duct and the extension duct.

9. A device as claimed in claim 6, wherein said weaving machine forms a cloth line and said blower device includes means for blower air from behind the thread guide duct in a direction toward said cloth line.

10. A device as claimed in claim 9, wherein said direction forms an angle of from 10° to 30°, inclusive, with respect to a weft direction.

* * * * *